US007494422B2

(12) United States Patent
Pegg

(10) Patent No.: US 7,494,422 B2
(45) Date of Patent: Feb. 24, 2009

(54) VERTICALLY MASS BALANCED PUTTER

(76) Inventor: Jeffry A. Pegg, 954 C.R. 3657, Springtown, TX (US) 76082

( * ) Notice: Subject to any disclaimer, the term of this patent is extended or adjusted under 35 U.S.C. 154(b) by 789 days.

(21) Appl. No.: 10/734,883

(22) Filed: Dec. 15, 2003

(65) Prior Publication Data

US 2005/0130762 A1 Jun. 16, 2005

(51) Int. Cl.
*A63B 53/00* (2006.01)
*A63B 53/04* (2006.01)

(52) U.S. Cl. ..... 473/292; 473/325; 473/340

(58) Field of Classification Search ..... 473/324–349, 473/313
See application file for complete search history.

(56) References Cited

U.S. PATENT DOCUMENTS 1,631,504 A * 6/1927 Redman ..... 473/313
4,063,733 A * 12/1977 Benedict ..... 473/313
4,444,395 A * 4/1984 Reiss ..... 473/335
5,728,009 A * 3/1998 Shanahan ..... 473/313
5,755,625 A * 5/1998 Jackson ..... 473/314
6,152,832 A * 11/2000 Chandler, III ..... 473/293
6,634,956 B1 * 10/2003 Pegg ..... 473/251
6,776,727 B1 * 8/2004 Engdahl ..... 473/340
2002/0151376 A1 * 10/2002 Verne ..... 473/314

FOREIGN PATENT DOCUMENTS

JP 10085371 A * 4/1998
JP 2003-117033 * 4/2003

* cited by examiner

*Primary Examiner*—Gene Kim
*Assistant Examiner*—Alvin A Hunter
(74) *Attorney, Agent, or Firm*—Jack A. Kanz

(57) ABSTRACT

The components parts of a putter are weighted and assembled to form a putter in which the vertical center of mass lies within the horizontal length of a preferred striking surface on the face of the putter. Vertically mass balanced putters with flat bottom surfaces stand alone on the green without external support, permitting the golfer to view the geometric relationship of ball, cup, putter and topography of the green from various distances and perspectives. Distribution of mass of the putter equally on opposite sides of its vertical axis permits the putter to be swung in a pendulum motion without imparting yaw to the moving striking face of the putter.

8 Claims, 2 Drawing Sheets

VERTICALLY MASS BALANCED PUTTER

This invention relates to golf putters. More particularly, it relates to putters which, when placed in striking position, have a vertical center of mass which lies within the horizontal length of a preferred striking surface on the face of the putter so that the mass of the putter is substantially balanced with regard to the vertical axis of the putter head.

Since golf courses are usually designed with par values for each hole which allow for only two putts per hole, it is evident that putting contributes significantly to a golfer's total score. Accordingly, successful and effective putting is highly desireable.

A wide variety of putters is available, all theoretically designed to aid or improve the golfer's putting skill and effectiveness. Golfers generally agree that the primary problems encountered in proper putting relate to controlling direction of the ball and to controlling the energy imparted to the ball to drive it to the hole. Direction is the path the ball must follow (and thus the direction in which it must be moved by the putter) and is determined by the contour of the green, i.e., the topography of the green between the ball and the cup. The energy to be applied is determined by the distance the ball must travel and the resistance provided by the green (green speed).

Ordinarily, golfers are trained to swing the putter in a pendulum motion when striking the ball to best control the direction and force applied to the ball. The pendulum motion aids the golfer in controlling the force (energy) applied as well as maintaining the angle of the face of the putter with respect to the ball. To determine the desired direction, it is usually necessary to view the topography of the green and the relationship between the ball, the cup and the striking face of the putter from different perspectives to determine the desired path of the ball. Once the desired initial direction of travel has been determined, the putter should be swung in a pendulum motion so that the striking face of the putter moves in the desired initial direction of travel but remains aligned perpendicular to the desired initial direction of travel. In conventional putters, however, the putter head usually extends substantially horizontally from the shaft in a direction away from the user. The mass of the putter head is therefor distributed outwardly from the shaft. Accordingly, when the putter is swung, the outwardly distributed mass of the putter head tends to cause the outer end (the toe) of the putter head to lag behind the shaft (and behind the heel) at the beginning of the swing and advance ahead of the shaft and heel toward the end of the swing, causing the striking face of the putter to deviate from perpendicular to the desired direction of travel. This deviation from perpendicular (sometimes called "roll", "twist" or "yaw") permits the putter to strike the ball when the striking face is not properly aligned, thus causing the actual path of the ball to deviate from the desired initial direction of travel.

In accordance with the present invention putters are provided which have components appropriately weighted, balanced and aligned to provide a balanced pendulum motion which maintains the striking face of the putter aligned perpendicular to the desired direction of travel throughout the swing. To achieve this result, the putters of the invention are arranged so that the vertical center of mass of the entire putter lies within the horizontal length of a portion of the striking surface which is horizontally centered on the striking face of the putter. Accordingly, as the putter is moved, the entire putter head advances uniformly. By maintaining the vertical center of mass substantially at the horizontal center of the striking face, unintentional yaw is reduced and the striking face remains perpendicular to the direction of travel through the entire swing. The putter of the invention thus permits an advantageously uniform pendulum motion to the stroke, aiding the golfer in accurately and precisely controlling the direction of force applied to the ball. Other features and advantages of the invention will become more readily understood from the following detailed description taken in connection with the appended claims and attached drawing in which:

Figure 1:
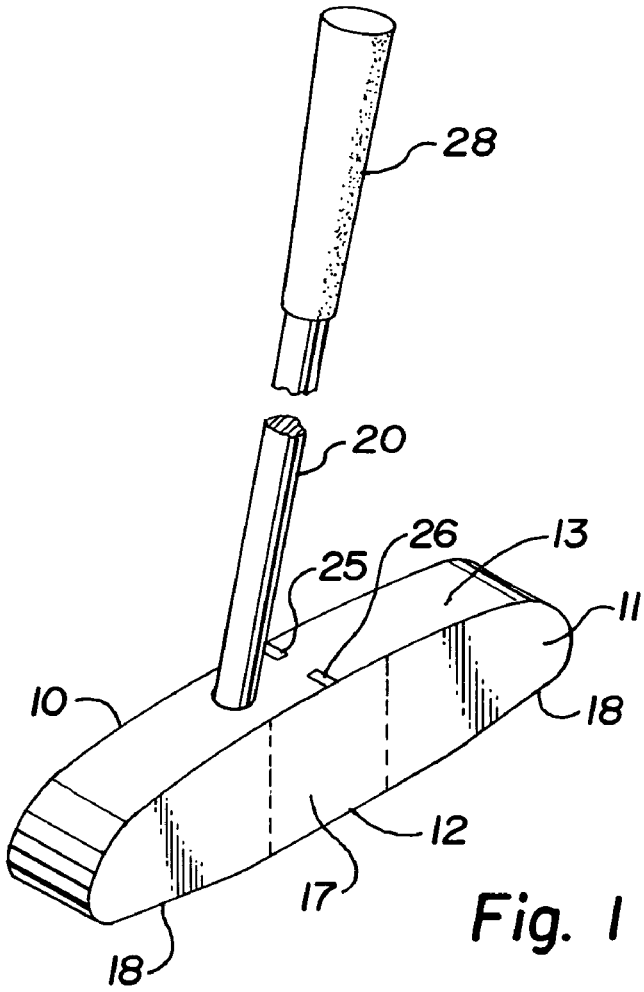
FIG. 1 is a perspective view of a preferred embodiment of the putter of the invention (illustrated with a portion of the shaft deleted)

The drawing is incorporated into and forms part of the specification to illustrate exemplary embodiments of the invention. For clarity of illustration, like reference numerals designate corresponding elements throughout the drawing. It will be recognized that the principles of the invention may be utilized and embodied in many and various forms. In order to demonstrate these principles, the invention is described herein by reference to specific preferred embodiments. The invention, however, is not limited to the specific forms illustrated and described in detail.

Figure 2:
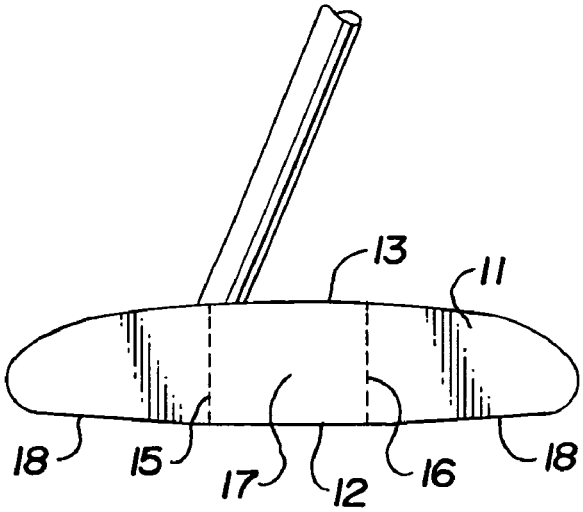
FIG. 2 is a front elevational view of the putter illustrated in FIG. 1.
Figure 3:
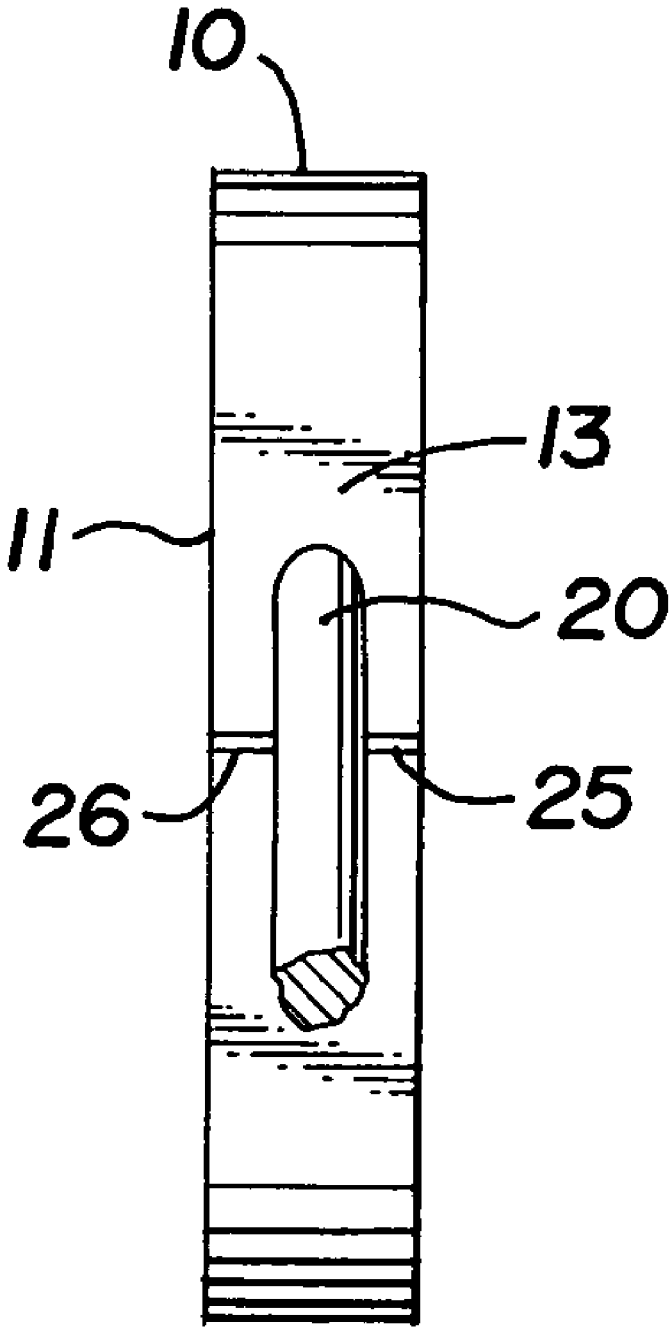
FIG. 3 is a top plan view of the putter illustrated in FIG. 1.

The embodiment of the putter illustrated in the drawing comprises a putter head 10 supported on one end of a conventional shaft 20 having a grip 28 on the opposite end thereof So long as the distributed mass of the shaft and grip comply with the mass distribution specified herein, these components may be conventional. Accordingly, the putter of FIGS. 2 and 3 is illustrated without the central portion of the shaft 20.

The putter head 10 comprises a body having a striking face 11, a bottom face 12 and a top face 13. The head 10 may be formed of any suitably dense material such as brass, steel or other composition. If desired, striker plates (not illustrated) of other materials such as titanium or the like may be inserted in the striking face 11. Otherwise, the body of the putter head is preferably of uniformly dense material but may be shaped and/or weighted to equally distribute the mass of the putter on opposite sides of the midpoint of the horizontal axis of the striking face 11.

The striking face 11 should be substantially flat or slightly convex (vertically and/or horizontally), as desired. The striking face 11 may be either positively or negatively inclined to suit the preferences of the golfer. Regardless of these minor variations, the striking face may be described as substantially vertical and is appropriately finished to provide the desired striking surface. The exterior finish on the remainder of the head 10 is determined merely by aesthetics.

The putter head 10 illustrated in FIG. 1 is essentially in the form of a conventional blade design. Obviously, putter heads of various other shapes may be employed in the putter of the invention.

In order to impart the desired directional force on the ball, the point of contact between ball and striking face should be the point on the face 11 which represents the center of mass of the putter. Conventionally, this point is the geometric center of the striking face 11. However, since striking the ball with the precise geometric center of the striking face is extremely difficult, a central portion of the striking face 11 comprising a surface area which extends approximately one (1) inch horizontally in each direction from the vertical centerline or horizontal midpoint of the head 10 defines a suitable striking surface described herein as the preferred striking area 17. In the embodiment illustrated the preferred striking area 17 is the portion of the striking surface 11 which lies between dashed lines 15 and 16 shown in FIGS. 1 and 2. Dashed lines 15 and 16 thus define the imaginary boundaries of an area which extends approximately one (1) inch in each horizontal direction from the horizontal midpoint of the striking face 11.

Since the putter head 10 is preferably symmetrical about its vertical axis and has a uniform density, the mass of the putter head is ordinarily uniformly distributed about its vertical axis. However, when a shaft is attached to the head in a conventional arrangement, the shaft and grip are offset from the vertical axis of the head, thus shifting the center of mass from the vertical axis of the head. Accordingly, if the shaft is attached to the head between the horizontal midpoint of the striking face and the heel of the club, the mass of the head (with respect to the shaft) is distributed toward the toe of the club but the mass of the entire putter is shifted toward the heel. Unless extreme care is taken when swinging a conventional putter, the toe tends to lag behind the heel at the beginning of the swing and advance ahead of the heel as the swing progresses, thus rolling or imparting yaw to the striking face.

In accordance with this invention, the components (head 10, shaft 20, grip 28) are arranged and assembled to distribute the mass of the assembled construction equally on opposite sides of a vertical plane which is normal to and intersects the axial length of the preferred striking area 17 of the striking face 11. This mass distribution may be accomplished by various means such as shaping or weighting the toe or heel of the putter head to compensate for the mass of the shaft and grip. In the preferred embodiment, however, the head 10 is of substantially uniform density and symmetrically weighted about its vertical axis. The head 10 does not, of course, need to be a simple blade shape as illustrated but may be otherwise shaped and/or include a striking plate or the like. In the preferred embodiment, however, such shaping, etc., should be arranged to maintain the mass of the putter head substantially equally distributed on opposite sides of the vertical axis of the head 10. To maintain the mass of the complete puffer equally distributed on opposite sides of the horizontal midpoint of the striking face, the shaft 20 is attached to the head 10 at point between the horizontal midpoint of the head and the toe end of the putter as illustrated in the drawing. Displacement of the attachment point of the shaft 20 toward the toe end is necessary to compensate for the combined mass of the shaft 20 and grip 28 because the shaft 20 does not extend vertically from the puffer head 10. Instead, the shaft 20 is inclined from vertical toward the heel of the head 10 to allow the golfer to address the ball from a point removed from the location of the ball. Thus the displacement distance of shaft 20 toward the toe end of the head depends on the mass of the shaft and grip, the length of the shaft and the angle at which the shaft deviates from vertical.

Putter shafts 20 are ordinarily between about thirty-two (32) inches and thirty-eight (38) inches in length. The combined mass of the shaft and grip is usually less than about five (5) ounces. The angle at which the shaft 20 deviates from vertical may vary from about 8 ° to about 25 ° . Accordingly, when the mass of the head 10 is uniformly distributed on opposite sides of the vertical axis, the mass of the shaft and grip must be likewise substantially distributed in opposite sides of the vertical axis. Such mass distribution is conveniently achieved by extending the shaft 20 from the top face 13 at a point between the vertical axis of the head 10 and the toe end. Depending on the mass of the shaft 20 and grip 28, the length of the shaft 20 and the angle at which shaft 20 deviates from vertical, the point at which the shaft 20 joins the head 10 may be displaced toward the toe end from less than one-fourth (¼) inch to as much as two (2) inches or more.

It should be noted that the combined mass of the putter components need not be centered at the precise vertical axis of the putter head 10. So long as the vertical center of mass lies within the horizontal length of the preferred striking area 17, the advantages of the vertical mass balanced putter of the invention will be achieved.

Joining the shaft 20 to top face 13 of the head 20 at a point between the horizontal midpoint of the putter head and the toe end thereof provides a unique method of visual alignment of the putter face. Conventional putters often include a mark such as a groove, line or the like on the top surface 13 of the putter head 10 extending perpendicular to the striking face 11 of the putter. This mark is usually positioned at the midpoint of the horizontal length of the putter and thus is used by the golfer to align the face of the putter with the ball and perpendicular to the desired initial path of the ball.

In accordance with the invention markers 25, 26 are positioned on top face 13 to extend from the back face and front face, respectively, of the putter head. Markers 25, 26 may be lines, grooves, dots or the like which extend completely or partially across the top face 13 at the horizontal midpoint of the head 10. Markers 25, 26 identify the horizontal midpoint of the striking face and extend in opposite directions from the geometric center of the putter head 10. Markers 25, 26 thus serve to align the ball and the putter head 10 with the desired direction of travel as in conventional putters.

As shown in FIG. 3 the markers 25, 26 may be used in combination with the shaft 20 to provide precise alignment of the putter face. Since the shaft 20 joins the putter head 10 between the horizontal midpoint of the putter head 10 and the toe end, the shaft 20 overlies the horizontal midpoint when the putter is viewed from the user's position. Accordingly, the golfer can precisely position the putter head to be properly oriented perpendicular to the desired direction of travel at the point of impact by positioning the putter adjacent the ball; aligning the markers 25, 26 with the ball and the desired direction of travel; and positioning the golfer's stance so that markers 25, 26 are equally visible on opposite sides of shaft 20. In this position, the golfer determines that the ball and striking face are properly aligned by referring to the position of shaft 20 with respect to markers 25, 26.

It will be recognized that substantially flat-bottomed putters which are vertically balanced as described herein may be positioned on the green in the striking position and remain free standing so that the golfer may move freely about the green to analyze the topography of the green and determine appropriate alignment for directional control of the path to be traversed by the ball. However, if the bottom face 12 is not sufficiently flat or does not cover a substantial area, and/or if the vertical mass of the putter is not precisely at the horizontal midpoint of the putter head, the putter will tend to fall. Where the bottom face 12 of the putter is relatively small (such as in the blade-type putter illustrated), free standing capabilities can be improved by making the central portion of bottom face 12 substantially flat. Since it is difficult to maintain the bottom face 12 perfectly parallel with the surface of the green while striking the ball, the bottom face 18 of the toe end and heel end may be rounded as illustrated to prevent unintentionally snagging an end of the putter on the green during the swing. By appropriately positioning and balancing the components to provide a free standing putter, the golfer may position the putter adjacent the ball and then view the relationship between ball, cup and putter from various angles and from various distances to determine the desired course of the ball.

While only a blade shape of putter heads is illustrated, it will be apparent that various combinations of the features disclosed may be used in a putter heads of various shape to incorporate and utilize the features of the invention. However, since the blade-type putter illustrated in the drawing is symmetrical, it may be used with equal success by both left-handed and right-handed golfers.

All components of the putter of the invention may be fabricated from readily available materials using conventional techniques and the shapes of various components may be modified to satisfy the particular desires of the individual golfer. Accordingly, the principles of the invention may be used to make putters of various designs, only some of which are illustrated and described in detail herein. It is to be understood, therefore, that even though numerous characteristics and advantages of the invention have been set forth in the foregoing description together with details of the structure and function of the various embodiments, this disclosure is to be considered illustrative only. Various changes and modifications may be made in detail, especially in matters of shape, size, arrangement and combination of parts, without departing from the spirit and scope of the invention as defined by the appended claims.

What is claimed:

1. A putter comprising:

(a) a putter head having a first mass and defining a bottom face, a top face and a striking face which defines a horizontal axis and which extends in a substantially vertical plane from said bottom face toward said top face and extends at least about four inches in a plane substantially parallel with said horizontal axis to define a preferred striking area approximately centrally located on said striking face and extending a distance of approximately one inch in each direction horizontally from the horizontal mid-point of said striking face; and (b) a shaft having a second mass and extending from the top face of said putter at an angle of from about 8° to about 25° from vertical with respect to said horizontal axis supporting a grip on the end thereof remote from said putter head and aligned so that the vertical center of mass of the putter lies within the horizontal length of said preferred striking area.

2. A putter as defined in claim 1 wherein said putter head is geometrically symmetrical about its vertical axis.

3. A putter head as defined in claim 2 wherein said shaft extends from said top face at a point between the toe end of said putter head and the vertical axis of said putter head.

4. A putter as defined in claim 3 wherein said putter head includes a marker on said top face thereof which identifies the horizontal midpoint of said striking face.

5. A putter as defined in claim 4 wherein said marker extends in opposite directions from the geometric center of said putter head.

6. A putter comprising:

(a) a putter head having a toe end, a heel end, a bottom face, a top face and a striking face which defines a preferred striking area approximately centrally located on said striking face and extending approximately one inch in each direction horizontally from the horizontal midpoint of said striking face;

(b) a shaft extending from said top face of said putter head at a position between said horizontal midpoint and said toe end at an angle of from about 8° to about 25° from vertical wherein said putter head and said shaft are arranged and weighted to align the vertical center of mass thereof within the horizontal length of said preferred striking area.

7. A putter as defined in claim 6 wherein said putter head includes a marker on the top face thereof which identifies the horizontal center of mass of said putter.

8. A putter as defined in claim 7 wherein said marker is equally visible on opposite sides of said shaft when the marker is aligned with a ball to be struck and said striking face is aligned perpendicular to the desired direction of travel of said ball.

* * * * *

UNITED STATES PATENT AND TRADEMARK OFFICE

CERTIFICATE OF CORRECTION

PATENT NO. : 7,494,422 B2
APPLICATION NO. : 10/734883
DATED : February 24, 2009
INVENTOR(S) : Jeffry A. Pegg It is certified that error appears in the above-identified patent and that said Letters Patent is hereby corrected as shown below:

Column 3
Line 37 should read --of the head 10. To maintain the mass of the complete putter--

Column 3
Line 45 should read --vertically from the putter head 10. Instead, the shaft 20 is--

Signed and Sealed this

Fourteenth Day of April, 2009

John Doll

JOHN DOLL
*Acting Director of the United States Patent and Trademark Office*